US006511307B2

(12) United States Patent
Popov et al.

(10) Patent No.: US 6,511,307 B2
(45) **Date of Patent: *Jan. 28, 2003**

(54) METHOD FOR PRODUCING A VACUUM BY A PUMPING-EJECTION SYSTEM

(75) Inventors: Serguei A. Popov, 4615 Post Oak Pl. Suite 140, Houston, TX (US) 77027; Anatoli M. Doubinski, Moscow (RU)

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

This patent is subject to a terminal disclaimer.

(21) Appl. No.: 10/095,148

(22) Filed: Mar. 11, 2002

(65) Prior Publication Data

US 2002/0146324 A1 Oct. 10, 2002

Related U.S. Application Data

(63) Continuation-in-part of application No. 09/269,930, filed as application No. PCT/IB98/01184 on Aug. 3, 1998, now Pat. No. 6,354,807.

(30) Foreign Application Priority Data

Aug. 5, 1997 (RU) ..... 97114240

(51) Int. Cl.[7] ..... F04F 5/00

(52) U.S. Cl. ..... 417/514; 417/77; 417/79; 417/88; 417/158

(58) Field of Search ..... 417/54, 77, 79, 417/88, 158

(56) References Cited

U.S. PATENT DOCUMENTS 1,732,930 A * 10/1929 Delas ..... 417/54
2,338,533 A 1/1944 Hickman

FOREIGN PATENT DOCUMENTS

| | | |
|---|---|---|
| DE | 569423 | 2/1933 |
| DE | 1092044 | 11/1960 |
| RU | 2016262 | 7/1994 |
| RU | 2016268 | 7/1994 |
| SU | 559098 | 7/1977 |
| SU | 1733714 | 5/1992 |

* cited by examiner

*Primary Examiner*—Ehud Gartenberg
(74) *Attorney, Agent, or Firm*—Mark A. Oathout

(57) ABSTRACT

A method for producing a vacuum, which includes feeding an ejecting vaporous medium into the gas ejector, evacuating an ejected gaseous medium by the ejecting vaporous medium, mixing of the vaporous and gaseous mediums and forming a mixture of the two, evacuating this mixture by a liquid-gas ejector whose nozzle is fed by a liquid ejecting medium, condensing the vaporous ejecting medium and its dissolving in the liquid ejecting medium in the liquid-gas ejector, forming a liquid-gas mixture and subsequent separating the liquid-gas mixture into compressed gas and a liquid phase which is used further as the liquid ejecting medium of the liquid-gas ejector. Substances which are reciprocally soluble in each other or mixtures of such substances are used as the vaporous and liquid ejecting mediums. A pumping-ejection system implementing the method includes a gas ejector, a liquid-gas ejector, a pump, a separator, a pressure pipeline and a vaporizing device for transforming a portion of the liquid ejecting medium into the vaporous state. An outlet of the vaporizing device is connected to the gas ejector, length of the pressure pipeline represents from 0.2 to 400 times that of its diameter. The introduced method and related pumping-ejection system exhibit an increased efficiency.

3 Claims, 1 Drawing Sheet

METHOD FOR PRODUCING A VACUUM BY A PUMPING-EJECTION SYSTEM

This application claims the benefit of and is a continuation-in-part of U.S. patent application Ser. No. 09/269,930 filed Aug. 21, 2000 now U.S. Pat. No. 6,354,807, which is a 371 of PCT application number PCT/IB98/01184 filed Aug. 3, 1998, and RU application number 97114240 filed Aug. 5, 1997.

BACKGROUND OF THE INVENTION

The invention pertains to the field of jet technology, primarily to the methods for producing a vacuum in the installations for processing a hydrocarbon feedstock and to pumping-ejection systems realizing these methods.

A method for producing a vacuum is known, which includes feeding a vapor ejecting medium into a gas ejector, evacuating a gaseous ejected medium by the vapor ejecting medium from an evacuated reservoir, mixing of the ejecting and ejected mediums and forming a mixture of the two, compressing the mixture due to its deceleration in a diffuser of the gas ejector, feeding a liquid ejecting medium into a nozzle of a liquid-gas ejector, evacuating the mixture of the vapor ejecting and gaseous ejected mediums from the gas ejector by the liquid-gas ejector, and forming a gas-liquid mixture in the liquid-gas ejector (see, DE, patent, 569423, class 27d,1,1993).

An ejector-pump installation realizing the above method is also described in the mentioned patent. The installation includes a gas ejector and a liquid-gas ejector. The gas ejector is connected to a source of an ejected gaseous medium through its inlet for evacuated medium. An outlet of the gas ejector is connected to the evacuated medium inlet of the liquid-gas ejector.

The mentioned method and installation do not provide independent operation, this causes additional energy consumption.

The closest analogue of the method introduced in the invention is a method for producing a vacuum, which includes feeding a vapor ejecting medium into the gas ejector, evacuating a gaseous ejected medium from an evacuated reservoir by the vapor ejecting medium, mixing of the ejecting and ejected mediums and forming a mixture of the two, compressing the mixture due to its deceleration in a diffuser of the gas ejector, feeding a liquid ejecting medium into a liquid-gas ejector, evacuating the mixture of the vapor ejecting and gaseous ejected mediums from the gas ejector, forming a liquid-gas mixture in the liquid-gas ejector and simultaneous compressing the gaseous component of this mixture, feeding the liquid-gas mixture into a separator, separating the liquid-gas mixture into the liquid ejecting medium and compressed gas (see DE, patent 1092044, class 17 d 5/05,1960).

A pumping-ejection system with the closest complex of main features is also described in the above patent. It includes a gas ejector, a liquid-gas ejector, a separator, a pump and a pressure pipeline. The suction side of the pump is connected to the separator, the evacuated medium inlet of the gas ejector is connected to a source of an ejected gaseous medium, an outlet of the gas ejector is connected to the evacuated medium inlet of the liquid-gas ejector, the liquid inlet of the liquid-gas ejector is connected to the discharge side of the pump, an outlet of the liquid-gas ejector is connected to the separator through the pressure pipeline.

The above described method for producing a vacuum and pumping-ejection system realizing this method provide for independent operation of the circuit of feeding a liquid ejecting medium. However, the introduced engineering solutions require feeding of a vapor ejecting medium from an external source. This limits application range of the method and related system. Specialty of the pressure pipeline design is a point of vital importance because it can affect operation of the whole system. In addition, these engineering solutions do not provide optimum selection of ejecting mediums. The latter also hampers organization of fully independent operation of the system and often results in additional energy consumption.

SUMMARY OF THE INVENTION

The present invention is aimed at an increase in operational efficiency of the method for producing a vacuum and related pumping-ejection system.

The problem is solved as follows: a method for producing a vacuum, which includes feeding a vaporous ejecting medium into a gas ejector, evacuating a gaseous ejected medium from an evacuated reservoir by the vaporous ejecting medium, mixing of the ejecting and ejected mediums and forming a mixture of the two, compressing the mixture due to its slowdown in a diffuser of the gas ejector, feeding a liquid ejecting medium into a liquid-gas ejector through its liquid inlet, evacuating the mixture of the vaporous ejecting and gaseous ejected mediums from the gas ejector and forming a liquid-gas mixture with simultaneous compressing of the gaseous component of the liquid-gas mixture, feeding the liquid-gas mixture into a separator, separating the mixture in the separator into the liquid ejecting medium and compressed gas, is modified so that the vaporous ejecting medium of the gas ejector and the liquid ejecting medium of the liquid-gas ejector are reciprocally soluble in each other and the process steps of condensing the vaporous ejecting medium and dissolving condensate of the vaporous ejecting medium in the liquid ejecting medium after entry of the vaporous ejecting medium into the liquid-gas ejector, are additionally introduced thereto.

It is possible to arrange multi-step compression of the gaseous ejected medium in the gas ejector. In addition the method makes it is possible to organize drawing off a portion of the liquid ejecting medium from the separator, vaporizing this portion of the liquid medium and feeding it under pressure into the gas ejector as the vaporous ejecting medium.

As regards to an apparatus for embodiment of the introduced method, the mentioned technical problem is solved as follows: a pumping-ejection system, including

- a gas ejector, whose evacuated medium inlet is connected to a source of an ejected gaseous medium and whose outlet is connected to the evacuated medium inlet of a liquid-gas ejector;
- the liquid-gas ejector, whose liquid inlet is connected to the discharge side of a pump and whose outlet is connected to a separator through a pressure pipeline;
- the separator;
- the pump, whose suction side is connected to the separator;
- a vaporizing device for conversion of a portion of a liquid ejecting medium into the vaporous state, an outlet of the device is connected to the ejecting medium inlet of the gas ejector, and length of the pressure pipeline represents from 0.2 to 400 times that of the pipeline diameter.

Research has shown that proper selection of ejecting mediums for gas and liquid-gas ejectors is the question of vital importance for operation of a two-phase pumping-ejection system. It was ascertained, that if substances or mixtures of substances chosen as a vaporous ejecting medium for the gas ejector and as a liquid ejecting medium of the liquid-gas ejector are well soluble in each other, such a mode of operation of the pumping-ejection system is achievable, which provides an increased compression ratio of an ejected gaseous medium while load on the liquid-gas ejector and consequently level of energy consumption remain the same. This mode of operation is realized because the gas ejector provides an increased pressure at the evacuated medium inlet of the liquid gas ejector. Experiments have shown that liquid hydrocarbons (for example, gas oil) satisfy this condition best of all. The use of hydrocarbons as the ejecting mediums allows transformation of a liquid medium into the vaporous state with considerably lower energy losses, if compared with water, for example. This, in turn, allows fully independent operation of the pumping-ejection system because in this case a portion of the liquid ejecting medium of the liquid-gas ejector can be transformed into the vaporous state and used as the vaporous ejecting medium for the gas ejector. And what is more, operation of the liquid-gas ejector in the mode of quasi-isothermal compression can be provided. This is the most energetically advantageous mode of operation for a liquid-gas ejector being an element of the pumping-ejection system.

Another point of significant importance is design of the pressure pipeline. It was ascertained, that the pressure pipeline connecting the liquid-gas ejector with the separator, whose length represents from 0.2 to 400 times that of its diameter, provides most favorable conditions for full completion of the processes of dissolution of the vaporous ejecting medium and condensation of condensable components of the ejected gaseous medium in the liquid ejecting medium of the liquid-gas ejector prior to entry of the mediums into the separator. Thus, load on the separator is reduced and the separator performs only its original function—the function of separation of a liquid-gas mixture into compressed gas and the liquid ejecting medium.

DESCRIPTION OF THE PREFERRED EMBODIMENT

Figure 1:
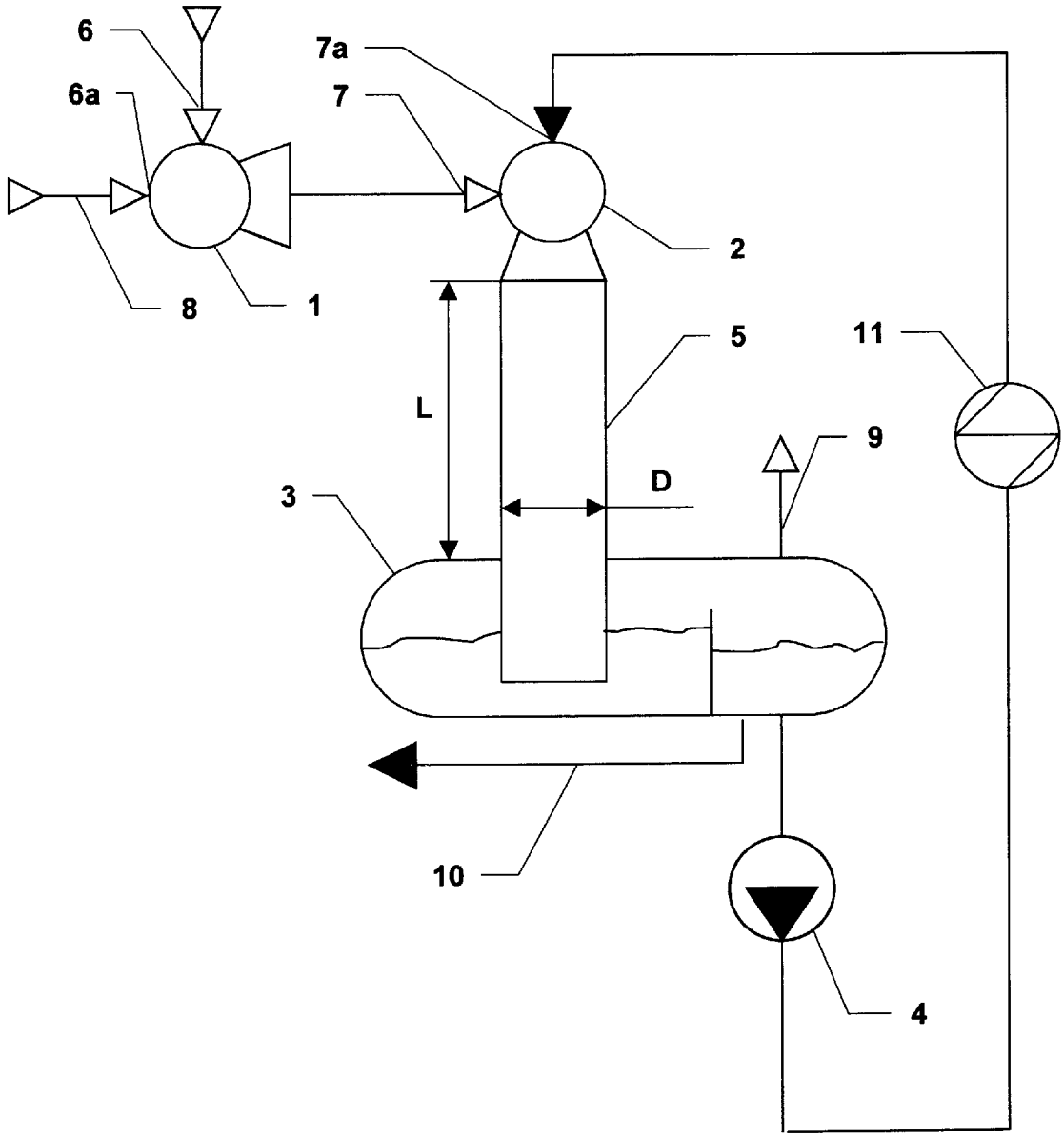
FIG.1 represents a schematic diagram of a pumping-ejection system implementing the introduced method for producing a vacuum.

The pumping-ejection system includes a gas ejector 1, a liquid-gas ejector 2, a separator 3, a pump 4, a pressure pipeline 5 and a heat exchanger-chillier 11. The suction side of the pump 4 is connected to the separator 3, the evacuated medium inlet 6 of the gas ejector 1 is connected to a source of an ejected gaseous medium, the ejecting medium inlet 6*a* of the gas ejector 1 is connected to a source (or vaporizing device) 8 of a vaporous ejecting medium, an outlet of the gas ejector 1 is connected to the evacuated medium inlet 7 of the liquid-gas ejector 2. The liquid inlet 7*a* of the liquid-gas ejector 2 is connected to the discharge side of the pump 4, an outlet of the ejector 2 is connected to the separator 3 through the pressure pipeline 5. The system is furnished with a vapor source or vaporizing device 8 connected to the ejecting medium inlet 6*a* of the gas ejector 1. Length L of the pressure pipeline 5 represents from 0.2 to 400 times that of its diameter D. The separator 3 is furnished with a pipeline 10 for discharging a surplus amount of the liquid phase (condensate of the vaporous ejecting medium) and a pipeline 9 for discharging the gaseous phase.

The described method for producing a vacuum is implemented as follows.

A vaporous ejecting medium is fed, for example from the vaporizing device 8, into a nozzle of the gas ejector 1 through its ejecting medium inlet 6*a*. Flowing out of the nozzle of the gas ejector 1, the vaporous ejecting medium evacuates an ejected gaseous medium from an evacuated reservoir (it is not shown in the drawing), which can be, for example, a rectifying vacuum column. The vaporous ejecting and gaseous ejected mediums mix in the gas ejector 1. The ejected medium is compressed by the vaporous ejecting medium during deceleration of a mixture of the two mediums in a diffuser of the gas ejector 1. Simultaneously, a liquid ejecting medium is fed by the pump 4 into a nozzle of the liquid-gas ejector 2 through its liquid inlet 7*a*. Flowing out of the nozzle of the liquid-gas ejector 2, the liquid ejecting medium evacuates the mixture of the vaporous ejecting and gaseous ejected mediums from the gas ejector 1. The evacuated mixture enters the ejector 2 through the inlet 7. During mixing of the liquid ejecting medium with the mixture of the vaporous ejecting and gaseous ejected mediums the vaporous ejecting medium is condensed and dissolves in the liquid ejecting medium. As a result, a liquid-gas mixture is formed in the liquid-gas ejector 2 and simultaneously the gaseous component of the mixture is compressed additionally by the liquid ejecting medium. The liquid-gas mixture from the liquid-gas ejector 2 is discharged into the separator 3 through the pressure pipeline 5. While moving through the pressure pipeline 5 the liquid-gas mixture is additionally compressed due to transformation of kinetic energy of the flow into potential energy of pressure and—in case of vertical disposition of the pressure pipeline 5—due to hydrostatic pressure influence. The compression of the liquid-gas mixture in the pipeline 5 causes condensation of easy-condensable components of the ejected gaseous medium (this situation is characteristic if a mixture of hydrocarbons is evacuated from the evacuated reservoir, for example during the vacuum rectification of heavy hydrocarbons). Proper design of the pressure pipeline 5, i.e. when its length represents from 0.2 to 400 times that of its diameter, is important for achieving optimal conditions for transportation of the liquid-gas mixture from the liquid-gas ejector 2 into the separator 3, and for completion of the processes of dissolving and condensation of mediums before the liquid-gas mixture gets into the separator 3. The liquid-gas mixture is separated in the separator 3 into compressed gas, which is discharged from the separator 3 through the pipeline 9 according to consumer's purpose, and the liquid ejecting medium, which is fed from the separator 3 into the nozzle of the liquid-gas ejector 2 by the pump 4. If it is provided for, a portion of the liquid ejecting medium can be delivered into the vaporizing device 8 for transformation of this portion of the liquid ejecting medium into the vaporous state and its subsequent feeding from the vaporizing device 8 into the nozzle of the gas ejector 1 as the vaporous ejecting medium. A surplus amount of liquid formed due to condensation of the vaporous ejecting medium and easy-condensable components of the evacuated gaseous medium may be discharged from the separator 3 through the pipeline 10.

INDUSTRIAL APPLICABILITY

The introduced method for producing a vacuum and related pumping-ejection system can be applied in the petrochemical, chemical and some other industries, where vacuum processes are used.

What is claimed is:

1. A method for producing a vacuum, comprising:

feeding a vaporous ejecting medium into a gas ejector, evacuating a gaseous ejected medium from an evacuated reservoir by the vaporous ejecting medium, mixing of the vaporous ejecting and gaseous ejected mediums and forming a mixture thereof, compressing the mixture by slowing it down in a diffuser, feeding a liquid ejecting medium into a liquid inlet of a liquid-gas ejector, evacuating the mixture of the vaporous ejecting and gaseous ejected mediums from the gas ejector, forming a liquid-gas mixture in the liquid-gas ejector and compressing the gaseous component of the liquid-gas mixture, feeding the liquid-gas mixture into a separator and separating the liquid-gas mixture into the liquid ejecting medium and a compressed gas, wherein the vaporous ejecting medium of the gas ejector and the liquid ejecting medium of the liquid-gas ejector are reciprocally soluble in each other, and condensing and dissolving the vaporous ejecting medium in the liquid ejecting medium in the liquid-gas ejector.

2. The method according to claim 1, further including organizing a multi-step compression of the gaseous ejected medium in the gas ejector.

3. The method according to claim 1, further including the step of condensing any condensable components of the gaseous ejected medium prior to said step of feeding the liquid-gas mixture into the separator.

* * * * *